United States Patent [19]

Sollinger et al.

[11] Patent Number: 4,848,268

[45] Date of Patent: Jul. 18, 1989

[54] APPARATUS AND METHOD FOR APPLYING A LIQUID TO A MOVING WEB

[75] Inventors: Hans-Peter Sollinger; Albert Woehrle, deceased, late of Heidenheim, both of Fed. Rep. of Germany, by Ingrid Woehrle, executrix

[73] Assignee: J. M. Voith GmbH, Heidenheim, Fed. Rep. of Germany

[21] Appl. No.: 62,960

[22] Filed: Jun. 16, 1987

Related U.S. Application Data

[63] Continuation-in-part of Ser. No. 731,529, May 7, 1985, abandoned.

[30] Foreign Application Priority Data

May 11, 1984 [DE] Fed. Rep. of Germany ..... 3417487

[51] Int. Cl.[4] ..... B05C 1/08

[52] U.S. Cl. ..... 118/227; 118/117; 118/119; 118/206

[58] Field of Search ..... 118/117, 118, 119, 227, 118/228, 206

[56] References Cited

U.S. PATENT DOCUMENTS

| | | | |
|---|---|---|---|
| 2,676,563 | 4/1954 | Montgomery et al. | 118/227 |
| 2,729,192 | 1/1956 | Warner | 118/117 |
| 2,946,307 | 7/1960 | Warner | 118/119 |
| 2,970,564 | 2/1961 | Warner | 118/227 X |
| 3,084,663 | 4/1963 | Warner | 118/104 |
| 3,387,585 | 6/1968 | Farrell | 118/118 X |
| 3,511,693 | 5/1970 | Davidson | 118/259 X |
| 4,316,428 | 2/1982 | Flaum et al. | 118/203 |
| 4,357,370 | 11/1982 | Alheid | 118/206 X |

FOREIGN PATENT DOCUMENTS

| | | | |
|---|---|---|---|
| 2103115 | 2/1983 | United Kingdom | 118/227 |

OTHER PUBLICATIONS

Wochenblatt for Papierfabrikation 1973, pp. 164 to 169.
Wochenblatt for Papierfabrikation 1978, pp. 773 to 778.

*Primary Examiner*—Shrive Beck
*Assistant Examiner*—Alain Bashore
*Attorney, Agent, or Firm*—Grimes & Battersby

[57] ABSTRACT

Apparatus for applying a liquid coating onto a moving web has one or preferably two rotatable rollers. In the two roller embodiment both rollers lie on the same plane which is at or near the horizontal. The two roller embodiment positions the rollers adjacent each so as to form a press nip between them. The moving web makes contact with one of the rollers, or the single roller along an extended circumferential arc of the roller. Adjacent each roller is a supply apparatus for depositing a liquid on to a portion of the roller jacket not in contact with the web. Wiper rods are associated with each supply apparatus and are biased against the jacket of the roller to make the coating of liquid uniform. Surplus liquid is used to wash the rollers to remove web fibers and glue and pigment particulate to avoid contamination thereby of the supply apparatus and wiper rods. The surplus liquid and fibers and particulate are collected in sumps.

4 Claims, 2 Drawing Sheets

APPARATUS AND METHOD FOR APPLYING A LIQUID TO A MOVING WEB

This application is a Continuation-in-Part of the U.S. patent application Ser. No. 06/731/529, filed on May 7, 1985.

BACKGROUND OF THE INVENTION

The invention relates to apparatus for applying a liquid onto a moving web, preferably a web of paper. In particular, the invention is concerned with such apparatus which is one of the type comprising at least one rotatable roller arranged to contact the moving web at one peripheral location; an appliance for supplying the liquid to the roller periphery or jacket; and a roller wiper having a rotatable wiper rod, which can be pressed by biasing means onto the roller jacket, which is located between the supply appliance and the peripheral contact location and arranged to extend across the width of the web for dispensing the liquid as a layer to move with the roller jacket towards said web.

Apparatus of this type can be arranged within or externally of a paper manufacturing machine, for example. The liquid to be applied can be a glue suspension, for example, within which the web of paper is impregnated, i.e. the glue suspension penetrates more or less completely within the web of paper. However, the liquid can also be a coating mass, such as pigment deposits of all sorts from which a color or a protective layer is formed on the web of paper. In both cases the liquid may be applied to one side of the web of paper or on both sides of the web of paper.

Prior Art Publications

1. U.S. Pat. No. 2,729,192
2. U.S. Pat. No. 2,946,307
3. U.S. Pat. No. 3,084,663
4. Wochenblatt for Papierfabrikation 1973 Pages 164 to 169
5. Wochenblatt for Papierfabrikation 1978 Pages 773 to 778

SUMMARY OF THE INVENTION

The invention is based on apparatus as shown in FIG. 1 of Publication 2, which apparatus serves to coat a web of paper on both sides. The web of paper firstly runs over an application roller which is of relatively small diameter. There liquid is applied to the lower side of the web of paper. Subsequently the web of paper travels through a gap formed between a large roller and a roller wiper. This roller wiper consists of a thin, rotatable wiper rod which is stored at the outermost end of an elastic support and can be pressed on to the roller jacket. In the upper part of the periphery of the larger roller, which is free from the web of paper, a further appliance is provided for the supply of a liquid. This appliance forms a liquid sump between the roller jacket and another roller wiper. This appliance forms a thin layer of liquid at the part of the roller jacket running downward which in the named gap is transferred to the web of papers. A disadvantage of this known construction lies in that with the above supply appliance only an extremely thin layer of liquid can be applied to the roller surface and consequently on to the upper side of the web of paper. This is caused by the smooth wiper rod running directly over the smooth surface of the roller and by the wiper rod having to be pressed on to the roller jacket with relatively great force in order to obtain a uniform thickness of the liquid film at right angles to the direction of travel of the web. For it has been observed that when the contact pressure between the wiper rod and the roller jacket is reduced, the uniformity of the film thickness applied to the web of paper (coated or impregnated with liquid), measured at right angles to the direction of travel of the web, leaves much to be desired. A further disadvantage of the known apparatus is that the gap through which the web of paper runs, that is, between the lower wiper rod and the roller, is only extremely short in the direction of travel of the web because of the extremely small diameter of the wiper rod. As a result, this prior apparatus is unsuitable for gluing (impregnating) a web of paper, because the contact force exerted in the gap of the web of paper only has an extremely short-term effect (on a specific point of the web of paper). The glue suspension is therefore not pressed into the web of paper properly. Therefore, for applying an impregnation glue to a web of paper, it has been the practice to use so called glue presses in which the web of paper passes between two rollers of approximately the same size (see Publications 5, FIG. 9). This arrangement provides that the contact force in the press gap can be selected substantially higher than in the arrangement disclosed in Publication 2, but a press zone substantially longer in the direction of travel of the web is also formed.

The object of the invention is to develop further liquid applying apparatus of the type discussed above in which the liquid can be applied as a film with a thickness which can be adjusted at random, and with as much uniformity as possible at right angles to the direction of movement of the web.

According to this invention apparatus of the type discussed above is characterized in that the periphery of the wiper rod is provided along its length with peripheral grooves.

A further object of this invention is to avoid contamination of the liquid application apparatus, in particular, disruption of the wiper rod, by fibers from the web which stick on the coating surface of the press rollers after the web disengages each roller jacket or by pigment or glue particulate which becomes dried on the rollers.

According to this invention, apparatus of the type discussed above is characterized in that excess liquid removed by the wiper rod wash fibers left on the roller jacket into sumps where they harmlessly sink to the bottom.

Thus the solution to the object is surprisingly found by a quite simple measure.

From Publication 3 is shown a wiper rod with a plurality of flute-type peripheral grooves. This known wiper rod however serves a purpose other than the wiper rod of the device in accordance with the invention. For in Publication 3 it is stated, under reference to Publication 1, that the wiper rod serves to strip excess coating mass from the moving web of paper.

In FIGS. 2 and 3 of Publication 4 is desired a wiper rod which consists of a rod which is coiled with a wire. This wiper rod also has peripheral grooves, but in the shape of a coil. Also in Publication 4 the purpose of the wiper rod is only given as the stripping of excess mass from a moving web of paper.

In contrast to the known use of grooved wiper rods, as described in Publication 3 and 4, in accordance with the present invention, a grooved wiper rod is used to produce a film of liquid directly on the periphery of a rotatable roller. Thus, Applicants have recognized that, with such a grooved wiper rod on the smooth jacket of the roller, films of liquid of very variable thickness can be produced, whereby in all cases the thickness is exceptionally uniform at right angles to the rotational direction of the roller jacket. This provides that the contact force with which the wiper rod is pressed on to the roller jacket can be finely adjusted in all operating conditions. In other words, the variation of the contact pressure, for the purpose of altering the film thickness, occurs at a very high level. Moreover, the film thickness, and consequently the quantity applied, can be varied by using wiper rods with varying groove depths.

By way of example, without limitation, a portion of a roller jacket is coated with a material and the surplus material is removed by doctoring rods so that the film of material remaining on the roller jacket is an uniform, thin coating or low coating weight of such material, which corresponds to a film thickness of 0.32 ounces of material per square yard, or lower. The low coating weight film of material on the roller jacket is transferred to one side of a running web. The uniform, low coating weight film so transferred to the one side of the running web has a film thickness which corresponds to a uniform coating of 0.25 ounces of coating per square yard of running web. It has been found that low coating weights of such magnitude are achieved with an excellent, smooth, uniform coating on the running web, having no streaks.

The apparatus in accordance with the invention can, if there is only a single roller, serve to apply liquid on only one side of the web. However such apparatus can also, as will be noted in FIG. 3 herein, be combined with additional application apparatus so as to also impregnate or coat the other side of the web.

However, the preferred embodiment of the invention is in two-roller glue presses. In known glue presses of this type (Publication 5, FIG. 9) a liquid sump is located on one side of the web of paper, or on both sides of the web of paper, directly on the periphery of one of the press rollers or on the periphery of both press rollers respectively.

In paper machines which run with a relatively low operating speed, glue presses of this type have proved their worth. In contrast, in fast-running paper machines problems arise for which a solution has been sought for years. One of the difficulties consists of the operating speed and the higher solids content used in the glue suspension. The unsteadiness in the sump can become so great that the glue suspension splashes about and the machine parts become contaminated. This gives rise to limitation of the solids content of the glue suspension to approximately 5 to 6% and/or the reduction of the operational speed of the paper machine. Another disadvantage of the known glue press is that the quantity of application per unit of area of the web of paper cannot be controlled to the desired extent. Inherent in this prior art construction is that uniform distribution of the contact force, over the width of the web of paper, is only guaranteed at a specific length of the entire contact force because of the known deformation of the rollers under contact force. In other words, if the entire contact force were varied, for the purpose of varying the quantity of glue applied, then the uniformity of the distribution of the application of glue at right angles to the direction of movement of the web of paper would suffer.

A further complication is that the web of paper receives variable quantities of glue suspension if it runs through the glue press with an irregular moisture content. It is well known, for example, that the web of paper receives more glue suspension at those places where it is relatively damp than at relatively dry places. This is all connected with the fact that in known glue presses the web of paper has to run through the glue suspension sump.

In accordance with the present invention it is henceforth possible to drive the glue press without a sump of the type previously used. This is accomplished by using the structure of the present invention which forms a film of liquid, the thickness of which can be held precisely within wide limits, the film being formed on the part of the periphery of one of the rollers or of both rollers which is free from the web of paper, said film being pressed into the press gap in the web of paper. By practicing the present invention the following advantages are achieved:

1. Glue suspensions or, if used, coating masses, with a substantially higher solids content than before, can be used for the liquid sump is not traversed by the web of paper; rather it is arranged apart from the web of paper so that the cause of splashing about of the liquid is eliminated. For the same reason substantially higher machine velocities can also be used.

2. Since the film of liquid produced on the roller(s) can be formed extremely uniformly at right angles to the direction of movement of the web, the quantity of liquid applied to the web of paper is also very uniform. This uniformity is also retained if the web of paper has an irregular moisture cross section. Even a possibly irregular distribution of the contact force at right angles to the direction of movement of the web no longer has any negative effects on the uniformity of the application of liquid. All this is possible because the web of paper receives the entire film or sheet of liquid transferred from the roller (or from both rollers).

3. The quantity of liquid applied can be determined within wide limits, independent of the speed and weight per unit area of the web, by a wiper rod (rods) being used with a determined groove depth.

BRIEF DESCRIPTION OF THE DRAWINGS

The present invention, including a preferred embodiment and alternate structural arrangements, is described below with reference to the accompanying drawings in which.

DETAILED DESCRIPTION OF THE INVENTION

Figure 1:
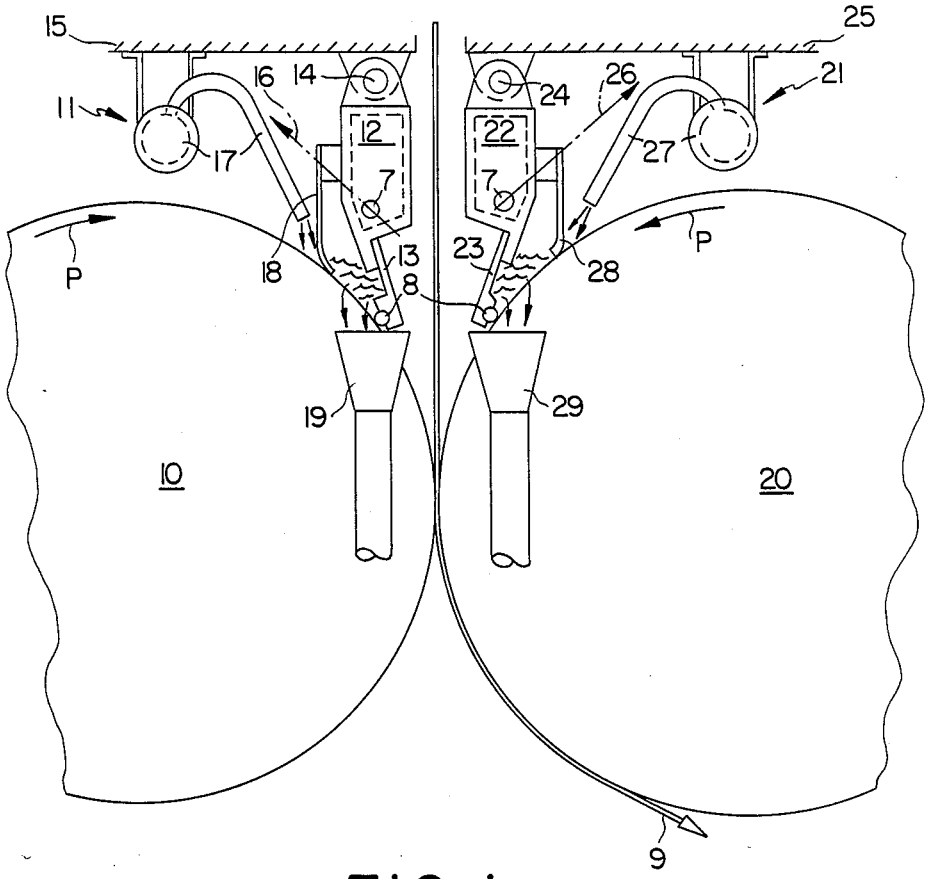
FIG. 1 represents a two-roller glue press, schematically presented, in side elevation, with liquid supply in the upper descending quadrant of the press roller.

In FIG. 1 are seen two rotatable press rollers 10, 20, which are arranged horizontally next to one another. The web 9 runs through the press gap formed by the two rollers from the top to the bottom. Above the upper descending quadrant of each press roller 10, 20 is provided a supply appliance 11, 21 for a liquid (glue suspension or coating mass). Each supply appliance includes a rotatably mounted wiper supporting beam 12, 22 which extends parallel to the press roller over its entire length. At the lower end of the wiper supporting beam 12, 22 is provided an elastic support 13, 23 for a rotatable wiper rod 8, which also extends over the entire roller length. The pressure of the wiper rod 8 on the press roller 10, 20 can be varied by tilting the wiper supporting beam 12, 22. The wiper supporting beams 12, 22 are suspended via swivel bearings 14, 24 on supports 15, 25 which are only shown schematically. In the lower region of each wiper supporting beam 12, 22 are journals 7 on which draw spindles 16, 26 act. The latter are only shown schematically by an arrow.

Figure 4:
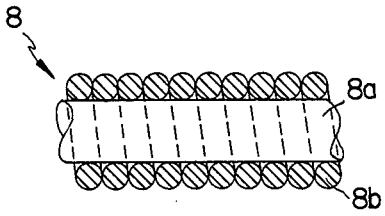
FIG. 4 represents, in enlarged scale, a section of a wiper rod employed with and part of the invention herein.

Fundamentally, a wiper rod, such as represented in FIG. 4, with peripheral grooves is provided The peripheral grooves can be circular or thread-like. FIG. 4 shows thread-like peripheral grooves. These result by a rod 8*a* being wound round with wire 8*b*. The diameter of the wire 8*b* used determines the cross-sectional area of the peripheral grooves and consequently the quantity of liquid entering through between the wiper rod 8 and the roller 10 or 20 respectively.

Each wiper rod has a drive or rotation device, which is already known, (not shown in the drawings). Each press roller 10, 20 also has a drive or rotation device (also omitted from the drawings). The rotational direction of the press rollers is marked by arrows P. Each wiper rod 8 is preferably driven in the same rotational direction as the appertaining press roller 10 or 20 so that at the contact point the periphery of the wiper rod runs contrary to the periphery of the press roller.

The addition of liquid to the area between the wiper supporting beam 12, 22 and the press roller 10, 20 can either result through the interior of the wiper supporting beam (not shown in the drawings) or with the aid of a known piping system 17, 27, as is evident from FIG. 1. A liquid sump is formed above the support 13, 23 of the wiper rod 8 on the jacket of the press roller 10, 20, which is however concealed by the wiper supporting beam, and if necessary by a flexible apron 18, 28. On both front sides of each press roller is located a lateral overflow 19, 29 to remove excess liquid.

Figure 2:
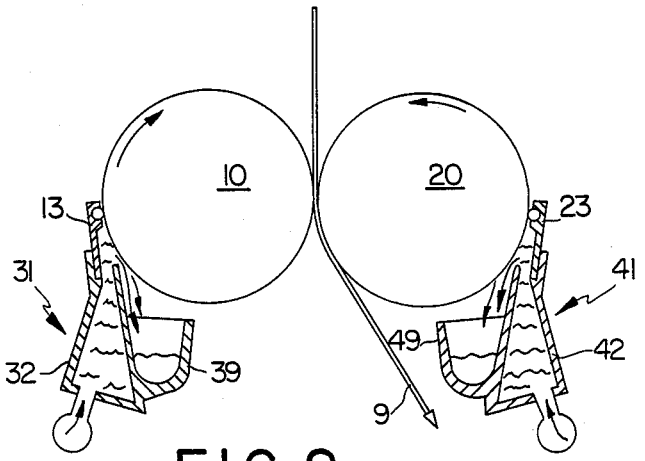
FIG. 2 represents a two-roller glue press, schematically presented, in which the liquid supply is arranged laterally in the ascending region of the roller jacket periphery.

The alternate embodiment shown in FIG. 2, which also provides for two press rollers disposed essentially horizontally next to one another differs from the embodiment shown in FIG. 1 in that the liquid supply applicators 12, 22 of FIG. 1 are supported over the upper descending quadrant of the rollers 10, 20. This provides for a gravitational feed of the liquid from each liquid supply 12, 22. The alternative arrangement of the dual press roller type of FIG. 2 provides for liquid supply applicators 32, 42 in the ascending quadrant of the press rollers. In this preferred embodiment the wiper supporting beams 32, 42 are constructed as nozzle chambers The elastic supports 13, 23 for the wiper rods 8 are fixed at the external boundary wall of the nozzle chambers 32, 42 respectively. Each of the nozzle chambers has a liquid outlet aperture aligned against the roller shell. Excess liquid flows out of the nozzle chamber counter to the rotational direction of the roller, through an overflow gap extending between the nozzle chamber and roller along the length of the roller, into a gutter or sump 39, 49. Preferably, the nozzle is arranged at the ascending part of the roller, as shown.

The excess liquid flows against the lower ascending portions of rollers 10 and 20, thereby washing fibers from the web or glue or pigment particulate off of the rollers before the rollers came into contact with the wiper rods 8.

In an alternative arrangement from the structure shown in FIGS. 1 and 2, the press roller axes may, if necessary, lie somewhat displaced or offset to one another with regard to height, so that the web 9 does not enter exactly vertically, but inclined from above into the press gap. In this case the wiper supporting beams are also displaced with regard to their height.

With the exemplified embodiments shown the web runs constantly from above into the press gap. If necessary the opposite running direction may be selected (if the rotational direction of the rollers is reversed). In this case the liquid supply appliances are to be arranged to correspond with the amended rotational direction of the rollers deviating from FIGS. 1 and 2.

Figure 3:
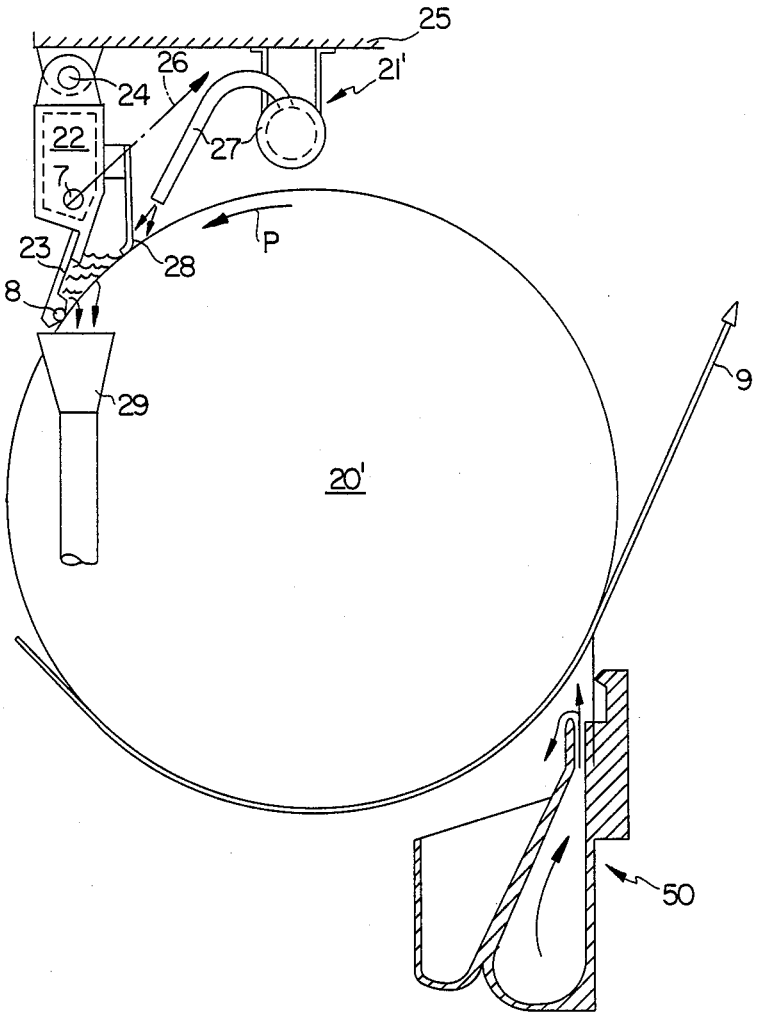
FIG. 3 represents, a single roller application device.

With the embodiment of the invention in accordance with FIG. 3, only one roller 20' having a liquid supply appliance 21' in accordance with the invention is provided, which is arranged in the upper descending quadrant of the roller, as in FIG. 1. It also serves to form a film of liquid, such as glue, for example, on the roller jacket which transfers the film to the upper side of a web of paper 9. The web is wound around a relatively large part of the lower part of the lower half of the roller jacket 20'. If desired a nozzle application mechanism 50 of orthodox design can further be arranged on the lower side of the roller 20' so as to apply a liquid, for example, a coating mass, on to the lower side of the web of paper 9.

Although the present invention is shown and described with reference to specific structure and certain alternate structure has been suggested, it will be appreciated that the teaching of this disclosure encompasses other arrangements, as will become obvious to those skilled in the art after reading this disclosure. Accordingly, the present invention should be limited only by the true scope of the appended claims.

What is claimed is:

1. Apparatus for applying a uniform coating of liquid onto a moving web of paper or the like, said apparatus comprising:

(a) a first and a second rotatable roller means each having a roller, each roller having a center and a peripheral surface with the centers of each roller on a common plane, each roller rotates in opposite directions, with the peripheral surface of each roller moving in the same direction as the web, said plane not deviating from the horizontal more than 20 degrees, said first and said second rotatable roller means in juxtaposition to define therebetween a press nit, wherein the web passes through said nip in a downward direction;

(b) means to drive the web in the downward direction;

(c) a first and a second supply means for applying a first and a second liquid, respectively, on to the peripheral surfaces of said first and second rotatable roller means, respectively, the first and the second liquids are applied onto the ascending portion of the peripheral surface of said first and second rotatable roller means, respectively, each of said first and second supply means includes a support beam which defines at least part of a chamber for receiving the liquid to be applied by the respective one of said first and said second supply means, each support beam having a flexible support means extending therefrom each of said flexible support means and respective support beam defines a nozzle means for introducing the liquid in said chamber directly onto a part of the peripheral surface of said respective one of said first and said second rotatable roller means, a wiper rod mounted on said flexible support means and biased toward said part of the peripheral surface of said respective one of said first and said second rotatable roller means, said wiper rod including peripheral grooves along the length thereof for uniformly spreading the liquid introduced on to the peripheral surface of said respective one of said first and second rotatable roller means into the uniform coating of liquid along the length thereof, wherein said apparatus applies the uniform coating of liquid which coating has a thickness of not more than 0.32 ounces of liquid per square yard of coating.

2. Apparatus for applying liquid onto a moving web as in claim 1 in which at least one of said nozzle means of said first and second supply means includes means for allowing excess liquid to be removed from the web.

3. Apparatus for applying liquid onto a moving web as in claim 2 in which said peripheral grooves on said wiper are helical.

4. An apparatus for applying a uniform coating of liquid onto a moving web of paper or the like, said apparatus comprising:

(a) a first rotatable roller and a second rotatable roller each having a center and a peripheral surface with the centers of each roller on a common plane, each roller rotates in opposite directions, with the peripheral surface of each roller moving in the same direction as the web, said first and said second rotatable rollers in juxtaposition to define therebetween a press nip, wherein the web passes through said nip in a downwardly direction;

(b) means to drive the web in the downwardly direction;

(c) a first and a second supply means for applying a first and a second liquid, respectively, onto the peripheral surfaces of said first and second rotatable rollers, respectively, the first and the second liquids are applied onto the ascending portion of the peripheral surface of said first and said second rotatable rollers, respectively, each of said first and said second supply means includes:

(1) a chamber for receiving the respective one of the first and the second liquids to be applied onto the peripheral surface of the respective one of said first and said second rotatable rollers;

(2) nozzle means positioned downstream of said chamber for depositing the respective one of the first and the second liquids onto the ascending portion of the respective one of said first and said second rollers;

(3) a support beam;

(4) a flexible support means extending from said support beam, wherein said support beam defines a part of said chamber; and (5) a wiper rod mounted on said flexible support means and biased toward said peripheral surface of said respective one of said first and second rotatable rollers, the wiper rod including peripheral grooves along the length thereof for uniformly spreading the liquid deposited onto the peripheral surface of said respective one of said first and said second rollers in order to form the uniform coating of liquid along the length thereof, wherein said apparatus deposits on the peripheral surface of each roller the coating of liquid which coating in its dry state has a thickness of not more than 0.32 ounces of liquid per square yard of coating.

* * * * *